US005450773A

United States Patent [19]

Darrah et al.

[11] Patent Number: 5,450,773

[45] Date of Patent: Sep. 19, 1995

[54] POWERED REVERSING RATCHET DRIVER

[75] Inventors: Scott A. Darrah, Raleigh, N.C.; Montie H. Miner, Granite City, Ill.

[73] Assignee: Madison Marketing Corporation, Granite City, Ill.

[21] Appl. No.: 58,831

[22] Filed: May 7, 1993

Related U.S. Application Data

[63] Continuation-in-part of Ser. No. 931,768, Aug. 18, 1992, abandoned.

[51] Int. Cl.[6] ..... B25B 13/46

[52] U.S. Cl. ..... 81/57.39; 81/63.2; 81/63

[58] Field of Search ..... 81/57.39, 62–63.2

[56] References Cited

U.S. PATENT DOCUMENTS

| | | | |
|---|---|---|---|
| 2,264,012 | 11/1941 | Wasson . | |
| 2,404,092 | 7/1946 | Reynolds | 81/624 |
| 2,491,624 | 12/1949 | Shaff . | |
| 2,578,686 | 12/1951 | Fish . | |
| 2,712,256 | 7/1955 | Fish . | |
| 3,186,265 | 6/1965 | Wenturine . | |
| 3,299,750 | 1/1967 | Campanile et al. | 81/62 |
| 3,529,498 | 9/1970 | Northcutt . | |
| 3,621,738 | 11/1971 | Northcutt . | |
| 4,328,720 | 5/1982 | Shiel . | |
| 4,346,630 | 8/1982 | Hanson . | |
| 4,602,534 | 7/1986 | Moetteli . | |
| 4,722,252 | 2/1988 | Fulcher et al. | 81/57.39 |
| 4,993,288 | 2/1991 | Anderson et al. | 81/57.39 |

OTHER PUBLICATIONS

Blue-Point Power Tools, AT700A, ⅜" Sq. Drive Ratchet Wrench brochure, (1 page).

*Primary Examiner*—James G. Smith

*Attorney, Agent, or Firm*—Flynn, Thiel, Boutell & Tanis

[57] ABSTRACT

A power-driven hand tool including a housing having first and second housing parts having first and second coaxial openings therethrough. A driving element is movably positioned between the housing parts and has a third opening in coaxial alignment between the first and second openings. A motor is mounted on the housing and connects through a motion-transfer device to the driving element for causing angular oscillation thereof about a tool-driving axis. An annular socket-driving member is rotatably supported within the first opening and has a bore therethrough coaxial with the axis for releasably but drivingly engaging a removable socket. The socket-driving member has a gear rotatably positioned in the third opening. First and second pawls are mounted on the driving element for engagement with the gear for respectively causing rotational driving movement of the socket in opposite first and second directions. A reversing member cooperates with the pawls and is movable between first and second positions for respectively permitting solely the first and second pawls to be drivingly engaged with the gear.

26 Claims, 3 Drawing Sheets

POWERED REVERSING RATCHET DRIVER

This application is a continuation-in-part of U.S. Ser. No. 07/931,768, filed Aug. 18, 1992 abandoned.

FIELD OF THE INVENTION

This invention relates to a power-driven hand tool assembly specifically for driving a socket, and particularly to an improved arrangement whereby the socket and tool assembly incorporate through openings, with the tool assembly also having a reversing mechanism for permitting driving of the socket in either rotational direction.

BACKGROUND OF THE INVENTION

The standard pneumatically-driven tool assembly contains a driving head for accommodating a standard socket, which driving head and socket do not define a through hole, and hence such assembly is restricted for use in those situations where the nut or bolt head are readily accessible and do not have an outwardly projecting threaded rod or equivalent.

In addition, many of the standard pneumatic tools do not incorporate a rotation reversing mechanism since the tools, particularly when used in assembly operations, are normally used for driving bolts or nuts in only a single rotational direction. Further, the known pneumatic tools which do provide for rotational reversing generally accomplish such reversing by use of a complex shifting mechanism, such as by shifting interior gears and pawls against the driving yoke, and such reversing mechanisms are typically positioned laterally spaced from the rotational axis of the driven socket.

Accordingly, it is an object of this invention to provide an improved powered driver for a tool, specifically a pneumatic ratchet driver for a socket, which driver not only cooperates with the socket to define a through hole to accommodate extension therethrough of an elongate rodlike member, but which also incorporates a rotational drive reversing mechanism preferably disposed in coaxial relationship to the through opening for permitting simple but manual selection in the direction of rotational drive.

In a preferred embodiment of the invention, the powered tool driver of the invention includes an elongate hollow housing which defines at one end an elongate handle part in which is provided a power-driven rotary motor, the latter effecting rotation of an intermediate drive mechanism which couples to a driving yoke provided adjacent the other end of the housing for effecting angular oscillation thereof. This other end of the housing defines a driving head and includes two cantilevered housing parts which project in generally parallel relationship and define a slot therebetween in which the driving yoke is positioned. The yoke and projecting housing parts define an opening extending therethrough in generally transverse relationship to the elongate direction of the housing, which opening accommodates a reversible socket-driving assembly. This latter assembly includes a tool or socket-driving member rotatably supported on one housing part for removably engaging a socket having a through opening therein. This socket-driving member is coaxially aligned with a drive reversing member which is rotatably supported in the other housing part. The socket-driving and drive reversing members are normally spring-urged toward one another but maintained rotatably isolated from one another through an intermediate bearing. The drive reversing member also has an opening extending coaxially therethrough for alignment and communication with the opening in the socket. The socket-driving member includes a gear portion rotatably positioned within an opening formed in the driving yoke, and the latter mounts thereon first and second spring-urged pawls adapted for engagement with the gear portion to effect driving thereof in opposite rotational directions. The drive reversing member includes a cam part which cooperates with the pawls to control the positions thereof relative to the gear portion. The cam part can be manually rotated into first and second positions which respectively permit solely the first and second pawls to drivingly engage the gear portion to permit rotational driving in opposite directions. The cam part can also be disposed in a third intermediate position, namely a neutral position, whereby both pawls are maintained out of driving engagement with the gear portion. Other objects and purposes of the invention will be apparent to persons familiar with structures of this general type upon reading the following specification and inspecting the accompanying drawings.

Figure 1:
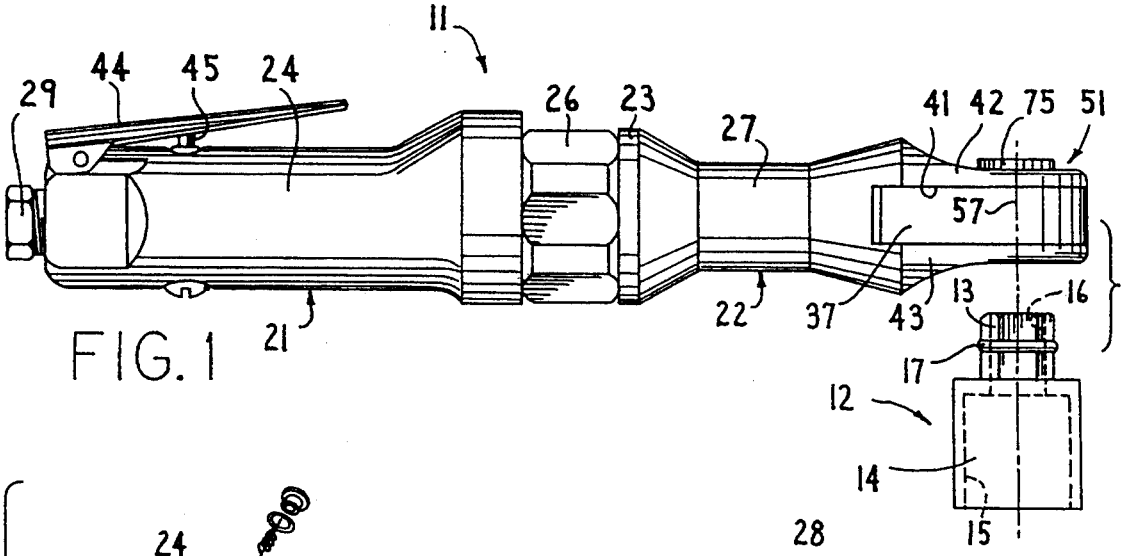
FIG. 1 is a side view illustrating the pneumatic tool driver and its cooperation with a removable socket.

Certain terminology will be used in the following description for convenience in reference only, and will not be limiting For example, the words "upwardly", "downwardly", "rightwardly" and "leftwardly" will refer to directions in the drawings to which reference is made. The words "inwardly" and "outwardly" will refer to directions toward and away from, respectively, the geometric center of the driver and designated parts thereof. Said terminology will include the words specifically mentioned, derivatives thereof, and words of similar import.

DETAILED DESCRIPTION

Figure 2:
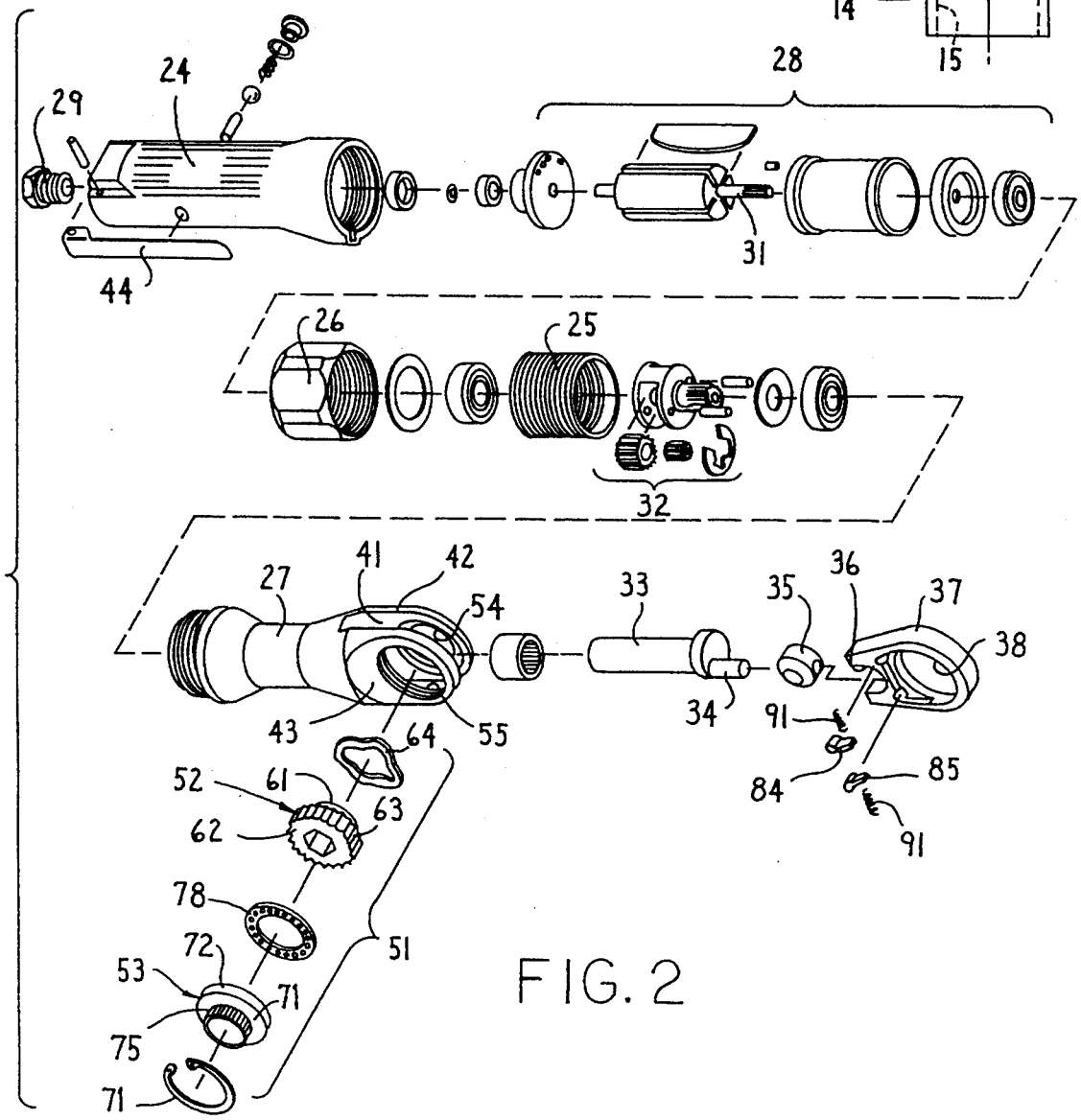
FIG. 2 is a perspective exploded view illustrating the pneumatic tool driver of the present invention.

Referring to FIGS. 1 and 2, there is illustrated a hand-held pneumatic tool driver 11, specifically a ratchet-type driver, intended for driving a removable socket 12. The socket 12 includes coaxially aligned driven and driving portions 13 and 14, respectively, the latter having an opening 15 which is conventionally of noncircular cross section, such as hexagonal or toothed, for accommodating a conventional nut or bolt head. A further opening 16 extends through the driving portion 14 and is in coaxial alignment and communication with the opening 15. A resilient ring 17 is captivated within a groove and externally surrounds the driving portion 13 for permitting securement of the latter to the tool driver 11.

The tool driver 11 includes elongate handle and driver parts 21 and 22, respectively, associated with opposite ends thereof. The driver is defined by an elongate and generally hollow housing 23 having an elongate handle housing part 24 which is internally threaded at one end for coupling to a threaded connector sleeve 25, the latter in turn being engaged with an internally threaded sleeve 26. This sleeve 26 in turn threadedly engages the rearward threaded end of an elongate driver housing part 27.

A rotary air-driven motor 28 is mounted within the elongate handle part 21, which motor is of a conventional rotary vane type, and is supplied with pressurized air through an air supply fitting 29 which is fixed to the rearward end of the housing, which fitting is coupled to a suitable air supply hose or conduit (not shown). The motor 28 has a rotary output shaft 31 which acts through a suitable gear reducer 32 to effect rotation of a rotary drive shaft 33 which extends longitudinally forwardly of the housing. Drive shaft 33 terminates in an eccentric drive pin or crank 34 which is engaged with a slide 35, the latter being confined within a slot 36 associated with a driving element or yoke 37. Rotation of motor 28 and of the eccentric drive pin 34 causes angular oscillation of the driving element or yoke 37. This yoke 37 has a socket-accommodating opening 38 extending therethrough, which opening projects generally transversely with respect to the elongate direction of the tool driver.

The forward end of the housing 23 has a slot 41 formed therein, which slot projects longitudinally inwardly from the free end of the housing and is defined between parallel cantilevered leg parts 42 and 43 which project forwardly of the housing and terminate at the free end thereof. The angularly oscillateable driving element or yoke 37 is positioned within the slot 41.

A trigger or lever 44 is positioned adjacent and has one end thereof rigidly supported on the housing. Trigger 44 is positioned for engagement with a plunger 45 which is movable inwardly upon depression of the trigger, in opposition to a spring, for controlling and opening a valve (not shown) which permits flow of air to the motor 28 for effecting rotation thereof whenever the trigger 44 is manually depressed.

The construction of the pneumatic tool driver 11, as briefly described above, is conventional so that further detailed description thereof is believed unnecessary.

The driver part 22 of the housing mounts thereon a reversible tool (i.e., socket) driver assembly 51 (FIGS. 3–5) which includes a tool-driving member 52 and a drive reversing member 53. These members 52 and 53 are respectively rotatably supported within cylindrical openings 55 and 54 which are formed within and extend in coaxial alignment through the cantilevered housing parts 43 and 42, respectively, whereby openings 54–55 communicate with and are coaxially aligned with the opening 38 associated with the yoke element 37. The opening 55 is of a stepped configuration and defines an annular shoulder 56 which faces upwardly toward the other opening 54. The three aligned openings cooperate to define an axis 57 which extends generally transversely relative to the longitudinal direction of the housing.

Considering now the socket-driving member 52, it includes a cylindrical hub portion 61 which is rotatably supported within the small diameter portion of opening 55, with the free end of this hub portion 61 being disposed adjacent the lower surface of the cantilevered leg part 43 of the housing. Cylindrical hub portion 61 is fixedly and here integrally joined to and coaxially aligned with an enlarged diameter drive portion 62 which has gear teeth 63 provided on the externally surrounding cylindrical profile thereof. This drive or gear portion 62 is disposed within the cylindrical opening 38 of the yoke member 37, which opening 38 has a generally smooth cylindrical wall so that the gear portion 62 is freely rotatably disposed therein. A suitable spring, such as an annular wave spring 64, cooperates between the housing leg part 43 and the lower end surface of gear portion 62 so as to normally resiliently urge the socket-driving member 52 upwardly to maintain it in a predetermined axial relationship relative to the drive reversing member 53.

The socket-driving member 52 has a tool-receiving opening 66 extending coaxially therethrough, which opening is of noncircular cross section and typically of hexagonal cross section so as to permit the hexagonal drive hub 13 of a conventional socket to be axially slidably inserted therein for nonrotational engagement with the socket-driving member. A groove 67 is preferably provided in surrounding relationship to the tool-receiving opening 66, at a location spaced axially between the opposite ends thereof, to receive therein the resilient O-ring 17 provide on the socket drive hub to hence provide a releasable axial securement of the socket drive hub within the tool-receiving opening.

Considering now the drive reversing member 53, it includes a generally cylindrical base or cam portion 71 which is rotatably disposed generally within the opening 54 defined within the upper housing leg part 42, which base portion 71 also projects axially downwardly into the opening 38 of the yoke member 37. The base portion 71 has a generally cylindrical outer cam surface 72 which extends therearound, although a portion of this outer surface 72 is removed by means of a flat or recess 73 as defined on one side of the base portion.

The drive reversing member 53 also has a generally cylindrical hub portion 74 which is of reduced diameter and is fixedly and here integrally joined to the base portion 71 and projects coaxially upwardly therefrom through the opening 54 so as to project at least a small distance beyond the upper surface of the housing leg part 42. This hub portion 74 has an exterior surface 75 which functions as a gripping surface. For this purpose the surface 75 is suitably roughened, such as by being provided with a knurled surface, to facilitate manual gripping thereof. A generally cylindrical opening 76 extends coaxially through the entirety of the reversing member 53, which opening 76 is axial aligned and in open communication with the tool-receiving opening 66.

The drive reversing member 53 is axially secured in position on the housing by a resilient locking ring 77 which is engaged with the upper surface of the base portion 71 and is confined within a surrounding annular groove as defined in the housing leg part 42. In addition, an annular bearing 78 is positioned between and cooperates with the opposed axial end faces of the base portion 71 and gear portion 62 to maintain a predetermined axial relationship therebetween, while at the same time allowing free relative rotation of the members 52 and 53 with respect to one another. This annular bearing 78, in the illustrated embodiment, comprises a ball bearing having a plurality of balls 79 confined within a suitable retainer ring, with the balls 79 being confined for rotation within shallow annular grooves 81 defined in the opposed axial end faces of the base portion 71 and gear portion 62.

To permit steplike rotational driving of the gear portion 62 in a selected direction, the pneumatic tool driver includess a gear driving structure 83 which includes the oscillateable yoke element 37 and also includes a pair of driving pawls 84 and 85 which are mounted on the yoke 37. The pawls 84 and 85 are disposed in sidewardly spaced relationship on the yoke member so as to be positioned for engagement with the gear portion 62 at circumferentially spaced locations. The pawls 84 and 85 project toward the gear 62 with generally reverse orientations so as to permit rotational driving of the gear portion 62 in opposite rotational directions. For example, when pawl 84 is engaged with the gear portion 62, it is capable of effecting rotation of the gear portion 62 in a clockwise direction in FIG. 4. Conversely, when pawl 85 is engaged with the gear portions 62, it is capable of causing counterclockwise rotation of the gear portion 62 in FIG. 4.

The pawls 84 and 85 are identical but are generally positioned in mirror image relationship with respect to one another relative to a central longitudinally-extending plane containing the drive axis 57. Each pawl 84 and 85 includes a generally cylindrical hub or pivot part 86 which is pivotally supported within a generally cylindrical bore 87 defined in the yoke member 37. The bore 87 communicates with a recess or slot 88 which is formed in the yoke member and is milled outwardly from the opening 38. The slot 88 has a depth which extends only partway through the thickness of the yoke 37, which depth is less than the depth of the bore 87. Each pawl 84 and 85 has an arm part 89 which is fixed to and projects radially outwardly from the respective hub part 86, which arm part 89 is positioned within the slot 88 and projects generally toward the externally toothed periphery of the gear portion 62. A compression spring 91 coacts between the yoke 37 and each pawl arm part 89 so as to normally urge the respective arm part toward the toothed periphery of the gear portion 62. However, the slot 88 is of sufficient depth to permit the arm part 89 to be retracted outwardly into the slot so as to be totally disengaged from the gear portion 62.

The tip or free end of each pawl arm 89 has a configuration thereon which is adapted to mate with the configuration of the gear teeth 63 on the gear portion 62 so as to provide for driving engagement therewith. The configuration of the pawls and gear teeth is conventional, so that further detailed description thereof is believed unnecessary. The pawl arms 89 are dimensioned and positioned so that they not only will engage the teeth 63 on the gear portion 62, but they also project axially upwardly a sufficient extent so as to engage the cylindrical outer surface 72 of the cam portion 71 as provided on the drive reversing member 53. The cylindrical outer surface 72 is of slightly larger diameter than the exterior diameter defined by the gear teeth 63 so that, whenever an arm 89 is engaged with the cylindrical outer surface 72, then the respective pawl is maintained out of engagement with the gear portion 62, substantially as illustrated by both pawls as appearing in FIG. 4. However, when the flat or recess 73 is positioned for radial alignment adjacent a selected pawl, such as adjacent the pawl 85 illustrated by FIG. 5, then the pawl is spring-urged radially inwardly by its respective spring 91 so as to be engageable with the teeth of the gear portion 62.

The operation of the pneumatic tool driver 11 of the present invention will now be briefly described.

A socket 12 is removably attached to the tool driver 11 by axially slidably inserting the drive hub 13 into the tool-receiving opening 66 of the driving member 52. When so inserted, the opening 66 of the drive hub 13 is aligned with the opening 76 in the drive reversing member 53, thereby defining a through opening so as to permit projection of a rod therethrough, such as a threaded rod which projects through a nut engaged within the socket opening 15.

To effect a ratchet-type stepwise rotational driving of the socket 12, the trigger 44 is manually depressed so as to supply pressurized air to the motor 28, which in turn effects rotational driving of the shaft 33 and eccentric drive pin 34 to cause the slide 35 to move back and forth within the slot 36 of yoke member 37. This hence effects angular oscillating movement of yoke member 37 between the housing leg parts 42 and 43. This angular oscillating movement of yoke 37 is then transmitted through one of the pawls 84 or 85 to cause a steplike directional rotational driving movement of the gear portion 62 and of the socket 12 carried thereby.

Figure 4:
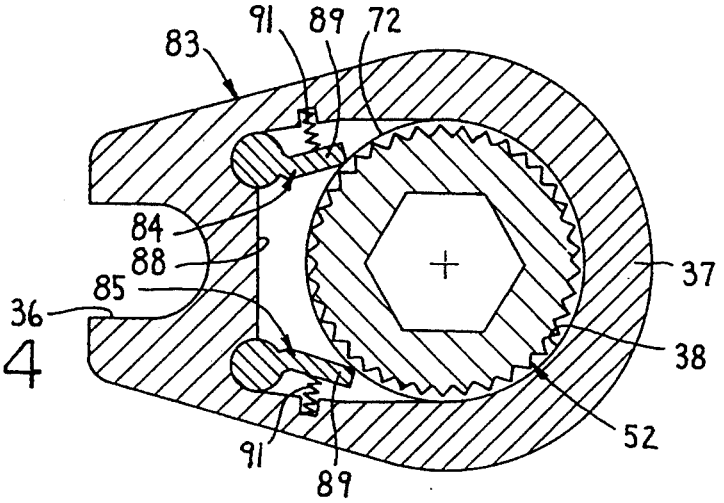
FIGS. 4 and 5 are sectional views taken substantially along lines 4—4 and 5—5, respectively, in FIG. 3.
Figure 5:
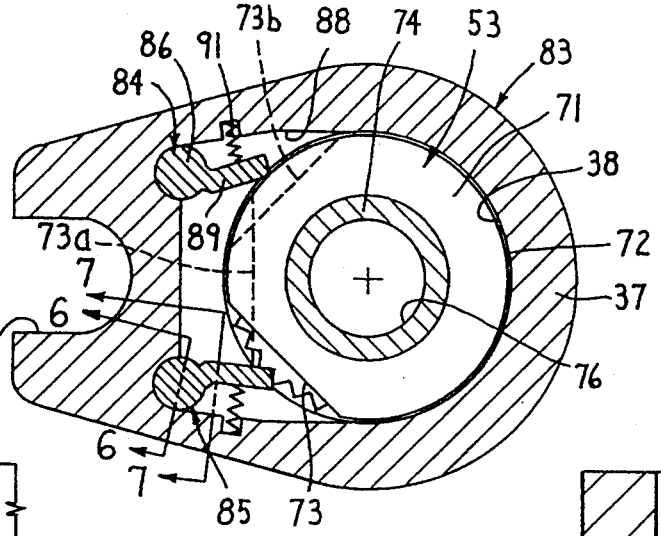
Figure 6:
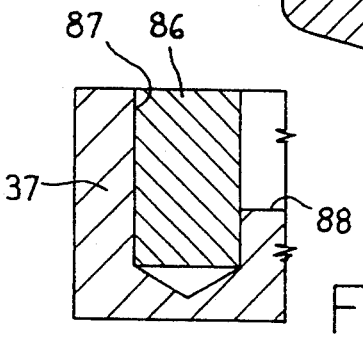
FIGS. 6 and 7 are enlarged sectional view taken substantially along lines 6—6 and 7—7, respectively, of FIG. 5.
Figure 7:
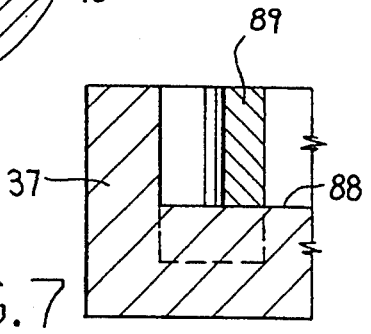

More specifically, when counterclockwise rotational driving of the socket in FIGS. 4 and 5 is desired, then the drive reversing member 53 is manually rotated so that the flat or cam part 72 is moved from the neutral position **73*a* shown by dotted lines in FIG. 5 to the solid line position shown in FIG. 5. This enables the pawl 85 to be spring-urged inwardly into engagement with the gear portion 62, while maintaining the pawl 84 in a nondriving position. Due to the driven angular oscillation of the yoke member 37, which causes a corresponding oscillating movement of the engaged pawl 85, the pawl 85 causes a rotatable counterclockwise steplike driving of the tool-driving member 52 and of the socket 12 engaged therewith during each counterclockwise angular oscillation of the yoke 37, with the pawl 85 freely running over the gear portion during each clockwise angular return stroke of the yoke 37. During this counterclockwise rotational driving of the tool-driving member 52, the drive reversing member 53 remains stationary relative to the housing due since the reversing member 53 is spring-urged against the snap ring 77 which effectively acts as a friction brake, and at the same time the annular bearing 78 as provided between the tool-driving and drive reversing member 52 and 53 permits free rotation of the tool-driving member 52 without causing corresponding rotation of the reversing member 53**.

When reverse rotational driving of the socket 12 is desired, than the drive reversing member 53 is manually gripped and rotated through an angle of about 90° so that the flat 73 is moved from the solid line position in FIG. 5 to the dotted line position **73*b* shown in FIG. 5. In this latter position only the pawl 84 is now engaged with the gear portion 62 and will effect rotational stepwise driving movement of the gear portion 62 and of the socket 12 in the opposite rotational direction, namely in the clockwise direction in FIGS. 4 and 5, in response to the driving angular oscillating movement of the yoke member 37. During this reverse rotational driving movement, the other pawl 85 is maintained out of driving engagement with the gear portion due to its engagement with the cylindrical exterior cam surface 72 defined on the cam portion 71**.

When it is desired to position the tool-driving member 52 in a neutral or nondriving position, then the reversing member 53 can be manually positioned in an intermediate position substantially wherein the flat or recess 73 is disposed at the position 73*a* indicted in FIG. 5. In this neutral or intermediate position, both pawls 84 and 85 are engaged with the cylindrical outer surface 72 of cam portion 71 and hence maintained out of engagement with the gear portion 62.

In the improved tool driver 11 of the present invention, various parts can be replaced by equivalent structures without departing from the spirit and intent of the invention. For example, while an annular ball bearing 78 is preferably provided for disposition between the driving and reversing members 52 and 53, other equivalent bearings can be provided, such as a plastic bearing washer (preferably a Teflon washer) which can be disposed between the opposed axial end faces of the members 52 and 53, which bearing washer will preferably be captivated within grooves provided in the opposed axial end faces. As to the wave spring 64 which creates the resilient biasing force axially within the socket-driving assembly 51, such spring 64 can assume many other conventional configurations. For example, a plurality of small coil-type compression springs can be seated within pockets formed in the housing and disposed circumferentially around the hub portion 61 so as to urge the driving member 52 axially upwardly against the reversing member 53.

As to the construction of the socket 12 having an opening extending axially therethrough, the construction thereof is conventional so that further detailed description thereof, other than to the extent described above, is believed unnecessary.

Figure 8:
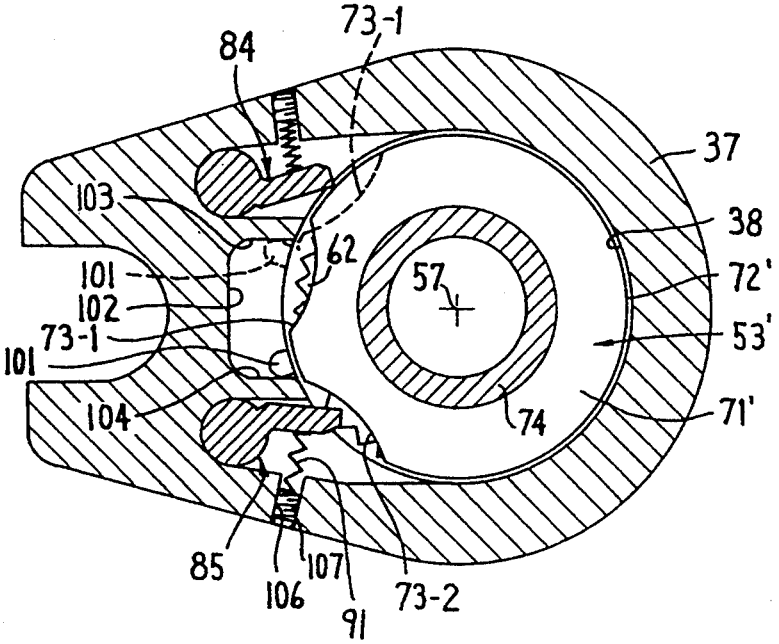
FIG. 8 is a sectional view similar to FIG. 5 but illustrating a variation of the invention.

Referring now to FIG. 8, there is illustrated a view similar to FIG. 5 but incorporating a variation of the invention, which variation relates to the drive reversing member and its cooperation with the pawls.

Figure 3:
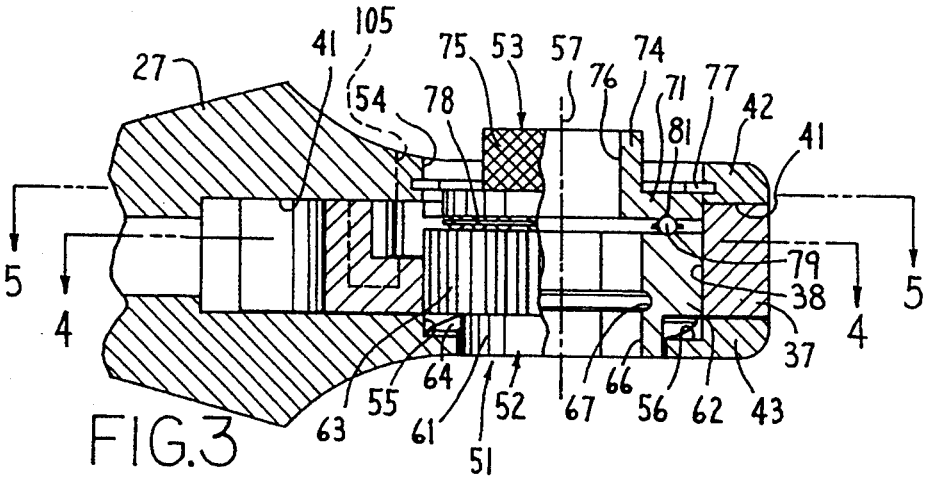
FIG. 3 is an enlarged, fragmentary, sectional view illustrating the driving head of the tool driver.

The drive reversing member 53′ of FIG. 8 again has the cylindrical base or cam portion 71′ thereof rotatably supported within the opening of the upper housing leg part in the same manner illustrated by FIG. 3, with this base portion 71′ projecting axially downwardly into the opening 38 of the yoke member 37. The base portion 71′ has a generally cylindrical outer surface 72′ which is partially removed to define a pair of flats or recesses 73-1 and 73-2 at angularly spaced locations therearound. The centerline to centerline angular spacing between these recesses 73-1 and 73-2 is substantially less than the angular spacing between the engagement points of the two pawls 84 and 85.

The base portion 71′ in the arcuate sector thereof disposed between the recesses 73-1 and 73-2, is provided with a pinlike stop or button 101 projecting radially outwardly from the outer peripheral surface thereof at a location circumferentially midway between the recesses 73-1 and 73-2. This stop 101 projects radially outwardly at least a small distance beyond the diameter of the peripheral surface 72′ (and hence beyond the maximum diameter of the ratchet wheel 62) into a slot or recess 102 formed in the yoke, which recess at opposite ends is defined by stop surfaces 103 and 104. The stop surfaces 103 and 104 permit limited rotation of button 101 therebetween so that the recesses 73-1 and 73-2 are adjacent the respective pawls 84 and 85 when the button is adjacent the respective stops 103 and 104.

More specifically, when the reversing member 53′ is rotated so that the button 101 contacts stop surface 104, the surface 72′ cams the pawl 84 into the release position. At the same time, the recess 73-2 aligns with pawl 85 so that pawl 85 engages the ratchet wheel. This same general cooperation exists when the reversing member 53′ is rotated counterclockwise so as to bring the button 101 into engagement with the stop surface 103.

To permit insertion of the reversing member 53′ through the upper housing arm into the yoke, the upper housing arm is provided with a small slot 105 (as indicated in dotted lines in FIG. 3) projecting radially outwardly from the bore 54, such slot being sized to permit the stop pin 101 to axially pass through the slot during assembly of the overall tool.

In operation, when tool rotation in the counterclockwise direction of FIG. 8 is desired, then the reversing member 53′ is manually rotated counterclockwise so that the stop 101 approaches the stop surface 104. This causes the outer surface 72′ to engage the pawl 84 and cam it outwardly out of engagement with the ratchet wheel 62. When the stop 101 reaches the stop surface 104, the other recess 73-2 aligns with the pawl 85 whereby this latter pawl is spring-urged into driving engagement with the ratchet wheel. During driving reciprocation of the oscillating member or yoke 37, the counterclockwise oscillations are effective in driving the ratchet wheel 62 in a counterclockwise direction about the axis 57. Any tendency for the reversing member 53′ to rotate with the ratchet wheel 62 during the forward (i.e., counterclockwise) movement thereof is positively prevented due to the engagement of the stop 101 against the stop surface 104. This hence is effective for preventing the reversing member from undesirably rotating with the driven ratchet member.

When driving of the tool in the reverse (i.e., clockwise) direction about axis 57 is desired, then the reversing member 53′ is manually rotated clockwise in FIG. 8 whereby surface 72′ cams the pawl 85 out of engagement and, when the stop 101 reaches the stop surface 103, the other recess 73-1 is aligned with the pawl 83 so that the latter is spring urged into engagement with the ratchet wheel. This thus permits operation in the same manner as described above but results in rotational driving of the ratchet wheel in the opposite direction.

With the improved power tool of the present invention, specifically incorporating the reversing structure of FIG. 8, it has been observed that the tool is capable of providing significantly increased driving torque and apparently provides much more efficient force-driving engagement from the oscillating yoke 37 through the pawls to the ratchet wheel 62. In particular, it is believed that a significantly increased number of oscillations are effective in transmitting driving force through the pawls to the ratchet wheel, and that less slippage between the pawls and ratchet wheel occurs during the driving strokes. While the exact reason for this increased efficiency and torque transmission is not fully understood, nevertheless it is believed that this is at least in part due to the desirable manner in which the reversing member and the stop cooperate with the pawls to hold one in a release position and prevent accidental rotation of the reversing member, and is also due to the overall positional relationship of the pawls being mounted on the yoke exteriorly of the ratchet wheel and hence more remotely positioned from the rotational axis 57, thereby permitting generation of larger forces at and through the pawls, with the pawls themselves being oriented so that the driving arm 85 when engaged with the ratchet wheel is elongated so that the arm projects approximately radially away from the pawl pivot axis and the arm itself is engaged with the ratchet wheel at a rather large transverse angle with respect to the ratchet radius so as to facilitate transmission of significant torque. In addition, the pawl and ratchet are designed such that the pawl engages only a single tooth of the ratchet wheel, with this engagement being oriented so that driving force transmitted generally radially along the arm of the pawl for transmission against the face of the ratchet tooth is in substantially perpendicular relationship, substantially as illustrated by FIGS. 5 and 8.

The invention is also preferably provided with the capability of adjusting the force of the springs 91 which bias the pawls independently toward their positions of driving engagement with the ratchet wheel. For this purpose the yoke 37 preferably has a through hole 106 formed in the wall thereof, which wall is preferably internally threaded and accommodates therein an adjustable set screw 107, one end of which acts as a seat for the spring 91. The spring is guided by the hole and, by bearing against the adjustable set screw 107, this enables the spring seat to be moved toward or away from the pawl to vary the biasing force imposed on the pawl.

While FIG. 8 illustrates the stop 101 fixed to the reversing member and projecting into an angularly extending slot or recess on the yoke, it will be appreciated that these structural and positional relationship can be reversed.

Further, while the tool of this invention is illustrated specifically for use with a pneumatic-driven motor, it will be apparent that other power sources can be utilized, such as electric motors, driven either by batteries or by conventional alternating current.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a motor-driven hand tool for driving a releasable socket, said hand tool including an elongate housing having a handle housing portion adjacent one end thereof and a driver housing portion adjacent the other end thereof, said driver housing portion being of a bifurcated construction including sidewardly spaced elongate first and second housing parts which are separated by an elongate slot which opens generally longitudinally inwardly from a free end of said driver housing portion, rotary power motor means disposed within said housing and having a rotary output which is rotatable about a first axis which extends generally longitudinally of said housing, socket-engaging and driving means movably supported on said driver housing portion for releasably engaging and rotatably driving a socket for rotation about a second axis which extends generally sidewardly of said housing, said socket-engaging and driving means including an oscillateable driving element movably positioned within the slot between said elongate housing parts, and motion transmitting means coupled between said motor means and said driving element for causing angular oscillation of said driving element about said second axis in response to rotation of said motor means, the improvement wherein said socket-engaging and driving means comprises:

a set of axially aligned first, second and third openings formed in and extending through said first and second housing parts and said driving element respectively, said openings being generally concentric relative to said second axis;

a socket-engaging member rotatably supported within and projecting generally through said second opening, said socket-engaging member having a socket-receiving bore extending axially therethrough, said bore having means associated therewith for nonrotatably engaging a driving hub of a socket;

said socket-engaging member including an annular gear portion rotatably positioned within said third opening;

reversing pawl means movably supported on said oscillateable driving element and having first and second positions of driving engagement with said gear portion for respectively rotating said socket-engaging member in clockwise and counterclockwise directions in response to angular oscillation of said driving element;

socket rotation reversing means for selectively moving said pawl means into either of said first and second positions;

said socket rotation reversing means including a manually engageable reversing member rotatably supported within said first opening and having a pawl-engaging portion rotatably disposed within said third opening in axially adjacent relationship to said gear portion; and said reversing member having a clearance bore extending axially therethrough in substantially coaxial alignment and axial communication with said socket-receiving bore.

2. A tool according to claim 1, including a socket removably attached to said tool, said socket having a driving hub which is axially slidably inserted into the socket receiving bore of said socket-engaging member, said socket also having a socket portion which is coaxially fixed to the driving hub and is positioned directly adjacent but externally of the second housing part, said socket having opening means extending coaxially therethrough.

3. A tool according to claim 1, wherein said gear portion and said reversing member have axial end faces which are positioned generally within said third opening in axially adjacent and opposed relationship to one another, and an annular bearing means disposed between said opposed axial end faces for permitting free rotation of said socket-engaging and reversing members independently of one another.

4. A tool according to claim 3, including a stationary brake surface normally maintained in engagement with said reversing member, and spring means for normally axially urging said reversing member into frictional engagement with said brake surface.

5. A tool according to claim 4, wherein said spring means is mounted on said housing and axially reacts against said socket-engaging member for urging said socket-engaging member axially toward said reversing member to hold said reversing member in frictional engagement with said brake surface.

6. A tool according to claim 5, wherein said reversing member has an annular hub portion which projects coaxially outwardly through and beyond said first opening and is provided with gripping means for permitting manual gripping and rotation thereof between said first and second positions.

7. A tool according to claim 1, wherein said pawl means includes first and second pawls movably mounted on said oscillateable driving element in sidewardly spaced relation relative to said gear portion, said first and second pawls projecting in opposite directions relative to the gear portion so as to respectively permit rotational driving of the gear portion in opposite rotational directions, said pawl-engaging portion being manually rotatable about said second axis between said first and second positions to respectively maintain said first and second pawls out of driving engagement with the gear portion, and spring means cooperating with each said pawl for normally urging each said pawl into a position of driving engagement with said gear portion.

8. A tool according to claim 7, wherein said pawl-engaging portion can be rotatably disposed in a third neutral position located generally between said first and second positions, said pawl-engaging portion when in said neutral position maintaining both of said first and second pawls in nondriving engagement with the gear portion.

9. In a power-driven hand tool for rotatably driving a releasable socket in a steplike rotational manner, said hand tool including a housing having first and second generally parallel and sidewardly spaced housing parts, said first and second housing parts respectively having first and second openings formed therethrough in generally coaxial alignment with one another, said first and second openings being concentric with respect to a tool-driving axis, a driving element movably positioned between said first and second housing parts and having a third opening therethrough which is disposed in coaxial alignment between said first and second openings and is positioned generally concentric with respect to said tool-driving axis, motor means mounted on said housing, and motion-transfer means connected between said motor means and said driving element for causing angular oscillating movement of said driving element about said tool-driving axis in response to driving of said motor means, the improvement comprising:

an annular socket-driving member rotatably supported on said first housing part within said first opening and having bore means extending axially therethrough in coaxial alignment with said tool-driving axis, said bore means including means associated therewith for releasable but nonrotatable driving engagement with a hub part of a removable socket element;

said socket-driving member including an annular gear portion freely rotatably positioned within said third opening;

first and second pawl means movably mounted on said driving element and positioned for driving engagement with said gear portion for respectively causing rotational driving movement of said socket-driving member in first and second rotational directions which are opposite one another;

rotation reversing means cooperating with said first and second pawl means and being movable relative to said housing between first and second positions for respectively permitting solely said first and second pawl means to be drivingly engaged with said gear portion to respectively cause rotational driving of said socket-driving member in said first and second directions; and said rotation reversing means including an annular manually-engageable reversing member rotatably supported on said second housing part within said second opening for rotation about said tool-driving axis, said reversing member having opening means therethrough in generally coaxial alignment with said bore means.

10. A hand tool according to claim 9, including annular bearing means disposed axially between adjacent opposed axial ends of said socket-driving member and said reversing member for permitting relative rotation therebetween.

11. A hand tool according to claim 10, wherein said reversing member includes a cam part disposed within said third opening in axially adjacent relationship to said gear portion, said cam part having a cam surface engageable with said first and second pawl means for controlling movement of each said pawl means between engaged and nonengaged positions relative to said gear portion in response to rotation of said reversing member about said tool-driving axis.

12. A hand tool according to claim 11, including spring means for normally resiliently urging said gear portion axially toward said revering member and for urging said reversing member into frictional engagement with a stationary brake surface associated with said housing.

13. A hand tool according to claim 12, wherein said reversing member includes an annular hub portion which projects coaxially through and outwardly beyond said second opening, said hub portion having a nonsmooth exterior surface to facilitate manual gripping thereof.

14. A hand tool according to claim 12, wherein said cam part defines a generally cylindrical platelike part concentrically fixed to said reversing member and having a recess provided in the periphery thereof, said recess when positioned radially adjacent one of the pawl means permitting the adjacent pawl means to be resiliently urged inwardly for driving engagement with the gear portion.

15. A hand tool according to claim 14, wherein the motor is pneumatically driven.

16. A power tool comprising a housing, a yoke movably mounted on the housing, the yoke being provided with an enlarged bore, a ratchet wheel rotatably mounted in said enlarged bore and including a central aperture which is concentric with the enlarged bore, power means for driving the yoke in alternating pivotal directions about said ratchet wheel, a pair of complementary pawls pivotally mounted in said yoke, each pawl sized for extending into the enlarged bore and into engagement with the ratchet wheel, biasing means for urging the pawls toward the ratchet wheel, and pawl control means disposed in said enlarged bore for selectively disengaging one of said pawls from contact with the ratchet wheel, the pawl control means being also provided with a centrally located aperture which is in coaxial communication with the aperture of the ratchet wheel whereby an elongated threaded member can be inserted through the enlarged bore and apertures and a fastener may be rotatably driven on the member by the power tool.

17. The tool of claim 16 wherein the pawl control means is supported for rotation about a central longitudinal axis defined by the enlarged bore and includes a manually-engageable annular hub part which is coaxially aligned with said axis.

18. A drive mechanism for use in a power driven ratchet comprising a housing, a yoke disposed in said housing and including a first annular bore defined about an axis, driving means for pivotally driving the yoke back and forth about the axis of said bore, said housing being provided with a complementary aperture which is coaxial to the axis of the bore, a ratchet wheel rotatably disposed in the bore for rotation about said axis, pawl means disposed in the yoke and including a first pawl and a second pawl each pivotally mounted in the yoke and each sized for extending into the bore and engaging a toothed periphery of the ratchet wheel, biasing means for biasing the first and second pawls toward the ratchet wheel, pawl control means for selectively holding a preselected pawl out of engagement with the periphery of the ratchet wheel, and the ratchet wheel and the pawl control means each being provided with a central aperture which is in alignment with the axis of the bore.

19. The mechanism of claim 18 in which the ratchet wheel is provided with means on an inner face of its aperture for securely holding a socket having a shaft-receiving bore extending therethrough, whereby to provide a reversible power ratchet which may be used to provide powered rotational forces to a fastener about a shaft regardless of the length of the shaft.

20. The mechanism of claim 19 wherein the pawl control means is supported for rotation about a central longitudinal axis defined by the enlarged bore and includes a manually-engageable annular hub part which is coaxially aligned with said axis.

21. In a power-driven hand tool for rotatably driving a releasable socket in a steplike rotational manner, said hand tool including a housing having first and second spaced housing parts respectively having first and second openings formed therethrough in generally coaxial alignment with one another and concentric to a tool-driving axis, a driving yoke movably positioned between said first and second housing parts and having a third opening therethrough in coaxial alignment between said first and second openings and generally concentric to said tool-driving axis, and driving means mounted on said housing for causing angular oscillating movement of said yoke about said tool-driving axis, the improvement comprising:

a socket-driving member rotatably supported on said housing and having bore means extending axially therethrough in coaxial alignment with said toodriving axis, said socket-driving member having a toothed portion;

first and second pawl means independently movably mounted on said yoke and positioned for driving engagement with said toothed portion for respectively causing rotational driving movement of said socket-driving member in first and second rotational directions which are opposite one another;

rotation reversing means cooperating with said first and second pawl means and movable relative to said housing between first and second positions for respectively permitting solely said first and second pawl means to be drivingly engaged with said toothed portion to respectively cause rotational driving of said socket-driving member in said first and second directions, said rotation reversing means including an annular manually-engageable reversing member supported for rotation about said tool-driving axis, said reversing member having opening means therethrough in generally coaxial alignment with said bore means.

22. A hand tool according to claim 21, including annular bearing means disposed axially between adjacent opposed axial ends of said socket-driving member and said reversing member for permitting relative rotation therebetween.

23. A hand tool according to claim 22, wherein said reversing member includes a cam part disposed within said third opening in axially adjacent relationship to said toothed portion, said cam part having a cam surface engageable with said first and second pawl means for controlling movement of each said pawl means between engaged and nonengaged positions relative to said toothed portion in response to rotation of said reversing member about said tool-driving axis.

24. A hand tool according to claim 23, including spring means for normally resiliently urging said toothed portion axially toward said reversing member and for urging said reversing member into frictional engagement with a stationary brake surface associated with said housing.

25. A power tool comprising a housing, a yoke movably mounted on the housing, the yoke being provided with an enlarged bore, ratchet wheel rotatably mounted in said enlarged bore and including a central aperture which is concentric with the enlarged bore, power means for driving the yoke in alternating pivotal directions about said ratchet wheel, a pair of complementary pawls pivotally mounted in said yoke, each pawl sized for extending into the enlarged bore and into engagement with the ratchet wheel, biasing means for urging the pawls toward the ratchet wheel, and pawl control means disposed in said enlarged bore for selectively disengaging one of said pawls from contact with the ratchet wheel, the pawl control means being a control member which is disposed within and supported for rotation about a central longitudinal axis of said enlarged bore.

26. The tool of claim 25, wherein the pawl control member comprises an annular plate which is disposed within the enlarge bore axially adjacent the ratchet wheel and has a surrounding peripheral surface provided with at least one recess for permitting one said pawl to engage the ratchet wheel.

* * * * *

UNITED STATES PATENT AND TRADEMARK OFFICE

CERTIFICATE OF CORRECTION

PATENT NO. : 5 450 773

DATED : September 19, 1995

INVENTOR(S) : Scott A. Darrah et al

It is certified that error appears in the above-indentified patent and that said Letters Patent is hereby corrected as shown below:

Column 12, line 19; change "revering" to ---reversing---.

Column 13, lines 43 and 44; change "too-driving" to ---tool-driving---.

Column 14, line 50; change "enlarge" to ---enlarged---.

Signed and Sealed this

Twenty-seventh Day of February, 1996

Bruce Lehman

*Attest:*

BRUCE LEHMAN

*Attesting Officer*

*Commissioner of Patents and Trademarks*